US005403217A

United States Patent [19]

Vosper

[11] Patent Number: 5,403,217

[45] Date of Patent: Apr. 4, 1995

[54] FOLDING BLADE PROPELLER

[76] Inventor: George W. Vosper, 149 Earl Street, Kingston, Ontario, Canada, K7L 2H3

[21] Appl. No.: 229,193

[22] Filed: Apr. 18, 1994

[51] Int. Cl.[6] ..... B63H 11/00

[52] U.S. Cl. ..... 440/49; 416/142

[58] Field of Search ..... 440/49, 50, 51, 53; 114/39.1; 416/142 A, 142 R

[56] References Cited

U.S. PATENT DOCUMENTS 3,981,613 9/1976 Ehrenskjold et al. ..... 416/142 A
4,290,760 9/1981 Lindbald ..... 114/53
4,768,927 9/1988 Munk ..... 416/142 A

*Primary Examiner*—Jesus D. Sotelo
*Attorney, Agent, or Firm*—Stanley E. Johnson

[57] ABSTRACT

A folding blade propeller for a power vessel wherein the blades are synchronized in their pivotal movement as they pivot from one position to the other by flexible links. The flexible links are connected at one end thereof to the base of one propeller blade and at the opposite to the base of another and act as pulling members. When one blade pivots the flexible link pulls on the base of the other blade to which it is attached to simultaneously pivot that blade. Slack in the links is minimized by having each link in rolling contact with rounded surfaces on the base of the respective propeller blades that are interconnected by that link.

13 Claims, 3 Drawing Sheets

FOLDING BLADE PROPELLER

FIELD OF INVENTION

This invention relates to improvements in folding propellers for use on sailboats.

BACKGROUND OF INVENTION

Drag from fixed blade propellers, on sailboats with inboard auxiliary engines, causes an appreciable loss of speed when under sail with the motor off. Propellers which have been designed to reduce drag are known and they are generally of two main types. One type is to have the blades which fold together to reduce the area that is impinged on by the water while the vessel is moving. The other is known as "feathered" blades which rotate to a fore and aft position where the blades cut through the water to minimize friction.

The known folding propellers normally have only two blades which are caused to open by centrifugal force when the propeller is turning and they are closed by drag on the blades through forward motion of the vessel in the water when rotation of the propeller is stopped.

The folding blade propellers are of two types, one in which the blades are free to open and close independent of one another and the other, and more expensive, is where the blades are geared to move in unison from one position to another. The freely pivoted blades work quite well and are generally less expensive but are not without some irritants. For example when the shaft stops, with the blades at or near the vertical position, the upper blade folds by virtue of gravity but the lower blade's weight makes it droop. This achieves only part of the hoped for drag reduction. Some racing yachts have bottom windows to view the propeller so that the shaft can be manually rotated to a position where both blades are folded to their inoperative position. It is not uncommon for a crew member to dive under a boat to place an elastic band around the blades to keep them folded together during a race. There is also the problem that should one blade stick and fail to open the resulting imbalance produces severe vibration when used.

Folding blade propellers, in which blades are interconnected to open and close in unison, eliminates some of the above disadvantages. While there may be other ways to achieve the interrelated movement the use of mating gears to do so is common. Here it might be mentioned that a folding blade propeller has two positions, one wherein the blades in the inoperative, or folded, position are essentially parallel to the axis of rotation of the propeller and in the other being the operative or open position where the blades are perpendicular to the axis of rotation.

In the known propellers with synchronized blades, each blade has a spur gear section concentric with its pivot axis to control the movement of the blades. The gears mesh with one another and as one blade rotates about its pivot mounting pin the other blade must open or close at the same rate. These gears are accurately machined to keep friction to a minimum. Foreign matter such as zebra mussels can impede the movement of the gears and limit the opening or closing of the blades.

Geared propellers normally are made either of bronze or cast iron. Cast iron propellers are less expensive than their bronze equivalent but have a serious drawback. Water near the surface usually contains a higher degree of dissolved oxygen. That tends to rust the mating faces of cast iron gear teeth. As rust forms, it is worn off with each folding, or unfolding of the blades, thus presenting a fresh new surface for further rusting. This combined rust-wear action quickly erodes the gear portion of cast iron propellers to the point that within a few years they fail to function and the propeller must be replaced. Badly rust-eroded gear teeth eventually skip or jam. Skipping causes non-synchronous motion. Jamming often locks one blade in the open position while the other remains folded. This creates severe imbalance. It can happen with no prior warning. The resulting vibration can make use of the engine impossible. In situations where use of an engine is essential, loss of power can render a vessel helpless and put it in severe danger.

SUMMARY OF THE INVENTION

An object of the present invention is to provide a folding propeller with a simple means for synchronizing motion of the blades during their movement from one to the other of first and second respective operative and inoperative positions.

A further object of the present invention is to provide a propeller with three folding blades and in which all of the blades are synchronized for movement from one to the other of their operative and inoperative positions.

In keeping with the foregoing there is provided in accordance with the present invention a folding blade propeller for use on the submerged end of a vessel's power driven shaft, said folding blade propeller comprising a hub mountable on the water immersible portion of said driven shaft, at least two blades, each said blade having a base and means pivotably mounting respective ones of the bases of said blades on said hub and link members interconnecting the bases of the propeller blades synchronizing their pivotal movement from one position to another of an operative position and an inoperative position, each said link member being a tension member which is attached at spaced apart first and second positions to the base of two different propeller blades and all of said link members relative to one another being functionally in criss-cross relation such that when one blade is caused to pivot, the link member attached to the base associated therewith pulls on the base of another blade forcing it to pivot and thereby synchronizing pivotal movement of all said blades.

LIST OF DRAWINGS

The invention is illustrated by way of example in the accompanying drawings wherein.

DESCRIPTION OF PREFERRED EMBODIMENT

Figure 1:
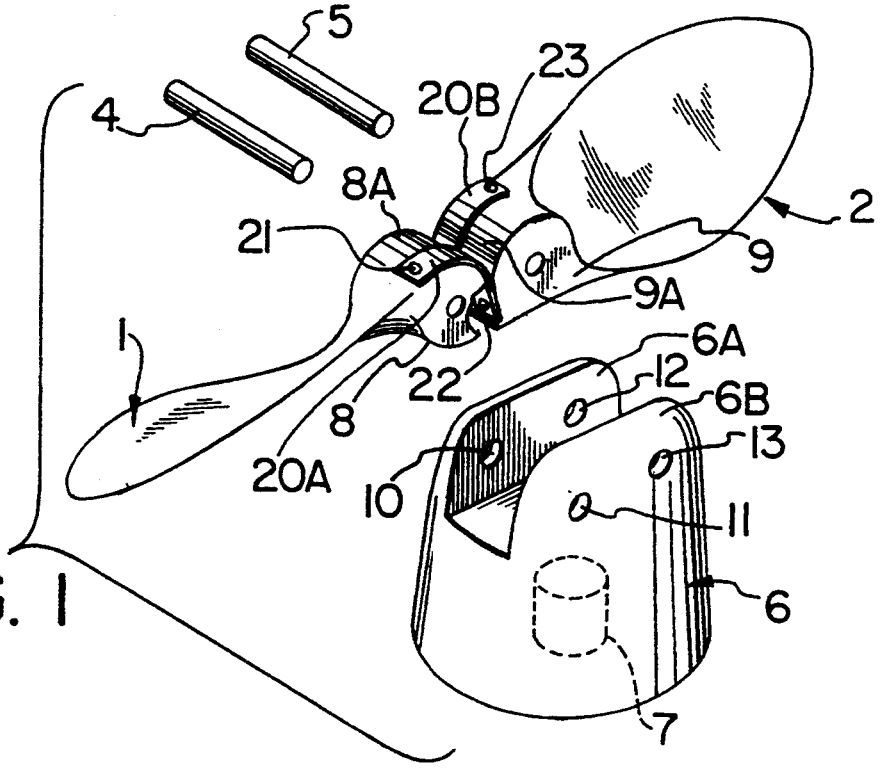
FIG. 1 is an exploded view of a two blade folding propeller provided in accordance with the present invention with synchronizing links.
Figure 2:
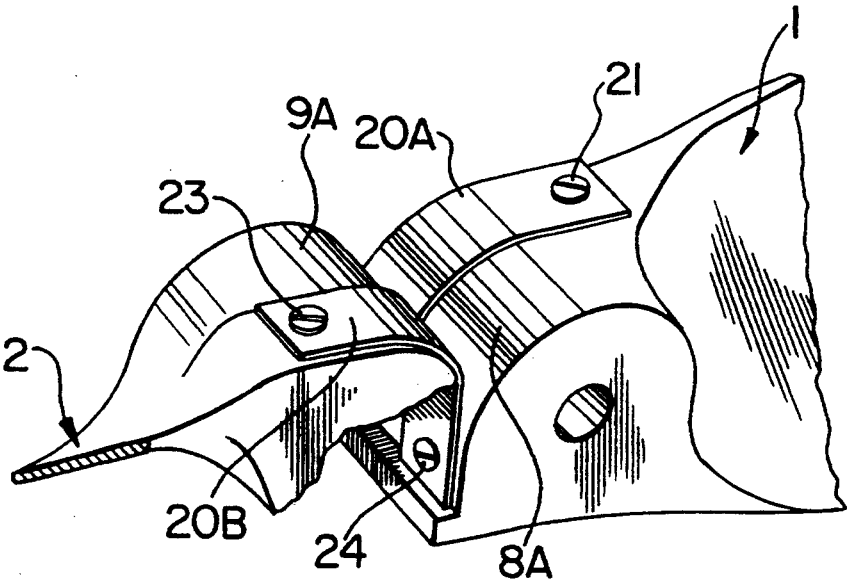
FIG. 2 is a partial sectional view of the base portion of the two blade propeller shown in FIG. 1 but from the opposite side.

Referring to FIGS. 1 and 2 (FIG. 1 being an exploded view) there is illustrated a propeller having two blades designated respectively 1 and 2 pivotally mounted by respective pivot pins 4 and 5 on a hub 6. The hub 6 has a recess 7 (which may be threaded or unthreaded) for mounting the hub on the water immersed end of a power driven shaft (not shown) of an auxiliary motor on a sailboat.

Blades 1 and 2 have respective bases 8 and 9 each apertured to receive respective pivot mounting pins 4 and 5. Pivot pin 4 fits into aligned apertures 10 and 11 in the hub flanges 6A and 6B and pin 5 fits into aligned apertures 12 and 13 in said respective flanges 6A and 6B.

The blades 1 and 2 are illustrated in FIG. 1 in their operative position in which they are essentially perpendicular to the pivot axis of the hub and with an appropriate pitch for the specific installation. The blades in their inoperative or folded position trail behind the hub and are essentially parallel to the hub's pivot axis. The blades 1 and 2 are synchronized in their movement from one position to the other of the respective operative and inoperative positions by link means which in the preferred form are flexible links such as straps, cables, combinations thereof or the equivalent.

Shown in FIGS. 1 and 2, are two flexible straps designated respectively 20A and 20B. Each strap is connected at one end to the base of one blade and at the other end to the base of the other blade. The connection of the straps to the base is at positions offset from the pivot axis of the blade mounting pin and the straps are oppositely oriented so that when one blade is caused to pivot on the hub one of the two straps will pull on the base of the other blade forcing it to pivot in synchronism with the other. The anchor points for the blades oscillate in axes about the pivot mounting pins associated therewith in directions generally toward and away from a plane that passes through the pivot axes of the pivot mounting pins. By way of reference such plane is perpendicular to the axis of rotation of the propeller.

Slack should be avoided in the straps while the blades pivot from one position to the other. An effective slack preventing means consists of a curved surface on the bases for the respective blades and these curved surfaces are located so as to be in rolling contact with the straps during movement of the blades from one to the other of their operative and inoperative positions.

The blades 1 and 2 are integrally formed with their respective bases 8 and 9 but obviously the blades and bases could be separately formed and joined together by suitable means.

The bases 8 and 9 have respective rounded surfaces 8A and 9A in face to face relation with the flexible links which are in rolling contact therewith. The two bladed propeller shown in FIGS. 1 and 2 has the two flexible straps in criss-cross relation and suitably anchored to the propeller bases. Strap 20A is anchored at one end by way of an anchoring means 21 to the base 8 of propeller blade 1 and at its opposite end it is anchored by anchoring means 22 to the base 9 of propeller blade 2. Similarly strap 20B is anchored at one end thereof to base 9 by way of anchoring means 23 and at the opposite end it is anchored to base 8 by anchoring means 24. As mentioned hereinbefore the straps are oppositely oriented relative to one another and herein are described as being in crisscross relation in their functional sense.

The straps between their respective spaced apart anchor points have their opposite faces in rolling contact with the curved surfaces 8A and 9A of respective blade bases 8 and 9. The straps 20A and 20B synchronize the movement of the blades as they pivot from one position to the other of the operative and inoperative positions. When one blade is caused to pivot one strap will pull on the base of the other blade forcing it to pivot in synchronism and vice versa so that it doesn't matter which blade is caused to pivot the other will be forced to do the same. Each strap functions as a tension member.

Figure 3:
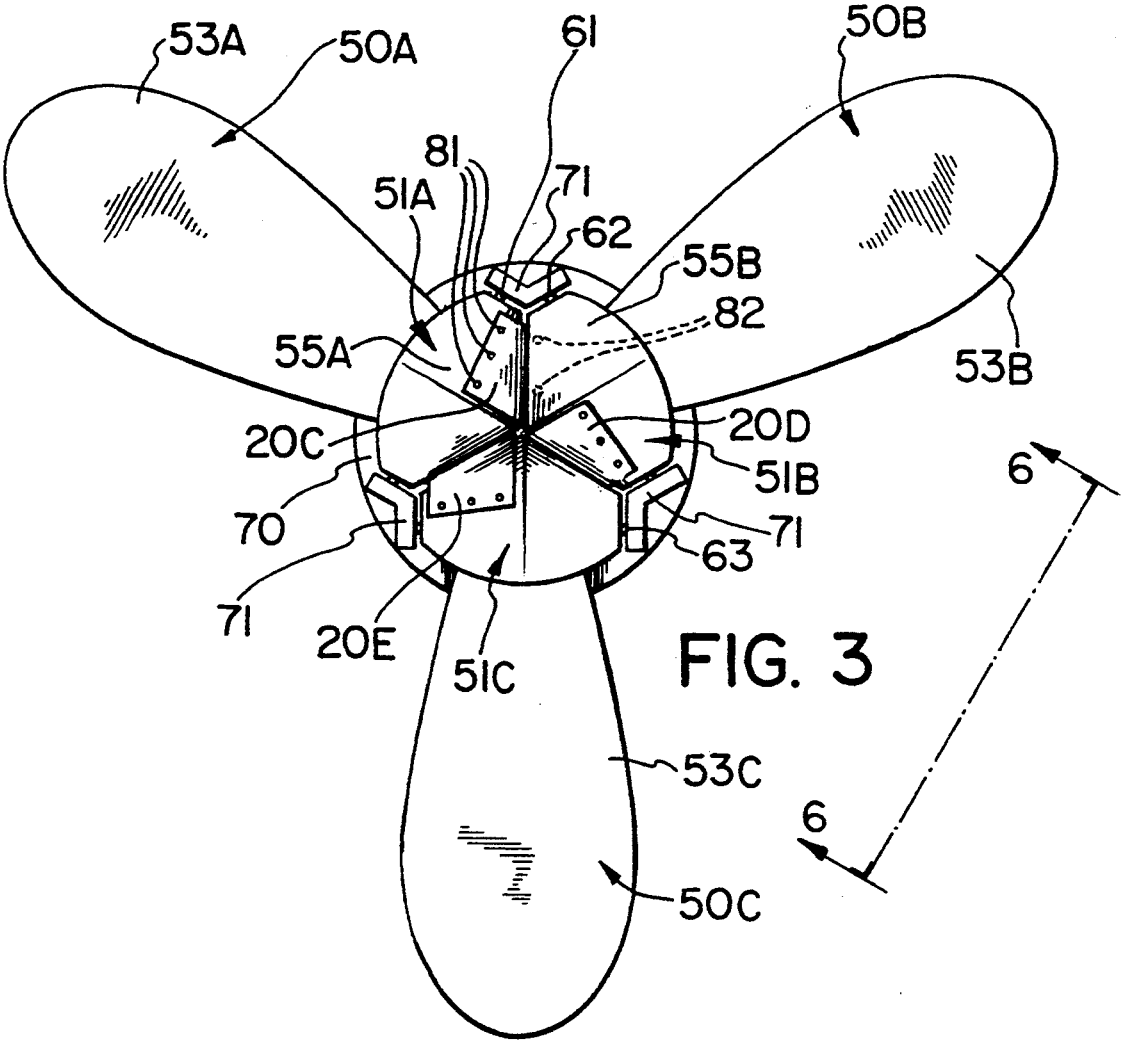
FIG. 3 is a rear view (taken downstream and looking upstream) of a folding three blade propeller provided in accordance with the present invention with the blades in their operative position.
Figure 4:
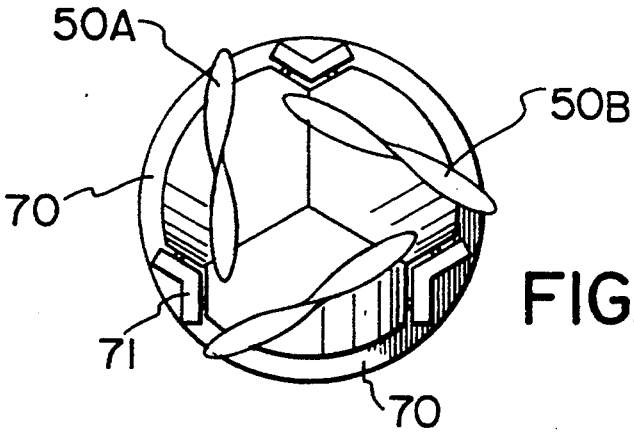
FIG. 4 is a view similar to that of FIG. 3 but with the blades folded to an inoperative or folded in position.
Figure 5:
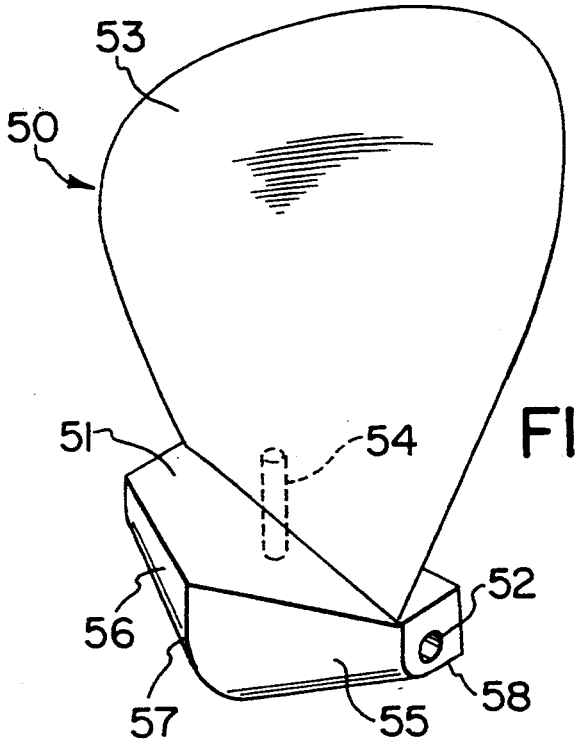
FIG. 5 is an oblique view of a single blade of the three blade propeller illustrated in FIGS. 3 and 4.

Referring particularly to FIG. 5 there is illustrated one blade unit 50 for a three bladed propeller which is illustrated in FIGS. 3 and 4. The blade unit 50 has a base 51 in which there is a through hole 52 for receiving a pivot mounting pin. The blade unit 50 has a blade 53 which may be integrally formed with the base 51 or attached thereto by way of for example one or more dowel type pins 54. If desired a single dowel pin can initially be used permitting varying the pitch and then separate anchoring means such as welding or the like may be used to secure the blade in the desired pitch position.

The base 51, illustrated in FIG. 5, has two segmental frusto-conical surfaces 55 and 56 with the axes for the surfaces of revolution coincident with the axis of the pivot pin mounting hole 52. Surfaces 55 and 56 meet at an apex 57 which, as will be noted hereinafter, is in a plane radiating outwardly from the axis of rotation of the propeller. The smaller radius of curvature for the surface is at the outer end of the base 51 and this curved end is designated 58.

Illustrated in FIGS. 3 and 4 is a propeller having three blade units of the type shown in FIG. 5 designated respectively 50A, 50B and 50C and having respective propeller blades 53A, 53B and 53C. The same reference numerals are used in FIGS. 3, 4 and 5 except in FIGS. 3 and 4 the letters A, B and C are added to distinguish one blade unit from that of another. The blade units have respective bases 51A, 51B and 51C that are pivotally attached by pivot mounting pins 61, 62 and 63 to a hub 70. The pins are secured (or journalled) at respective opposite ends on flanges 71 projecting from the hub 70.

The blades 53A, 53B and 53C are illustrated in FIG. 3 in their operative position in which they are essentially perpendicular to the pivot axis of the hub and with an appropriate pitch for the specific installation. FIG. 4 illustrates the blades in their inoperative or folded in position. The blades 53A, 53B and 53C are synchronized in their movement from one position to the other of the respective positions illustrated in FIGS. 3 and 4 by flexible straps designated 20C, 20D and 20E. These flexible straps are physically in the form of a developed surface of a cone and each is connected at one end to the base of one blade and at the other end to the base of another blade. The connection of the straps to the base is at a position offset from the mounting pin pivot axis. Also it will be noted that with respect to each strap the anchored opposite ends thereof move in arcs about the pivot axis in directions toward and away from a plane that passes through the pivot axis of the mounting pins during pivotal movement of the blades from one to the other of their first and second respective operative and inoperative positions. For example in FIG. 2 the propeller blades are shown in their operative position and during pivotal movement to their other position (i.e. inoperative position) anchor 23 for stop 20D moves in an arcuate path about the pivot mounting pin for propeller blade 2 and the direction is towards a plane that passes through the pair of pivot axes of mounting pins 4 and 5. During this pivotal movement the anchor 24 at the opposite end of the same strap 20D moves in an arcuate path in a direction away from that plane. The precise location and positioning of the anchor points will depend upon desired characteristics and amount of pivotal movement required. The strap itself moves along a predetermined path as defined by the curved surfaces on the bases for the blades. These curved surfaces are also a slack preventing means for the straps since the straps are in rolling contact with the curved surfaces as the blades pivotally move from one to the other of their operative and inoperative positions.

Referring to FIG. 3, strap 20C is anchored, adjacent an end thereof by securing means 81 to base 51A and the opposite end of such strap 20C is anchored by securing means 82 to base 51B. The strap 20C, between its anchored ends, has a part of one face thereof in rolling contact with a portion of surface 55A on the base 51A and part of the opposite face in rolling contact with a portion of the curved surface 56B on base 51B. Similarly strap 20D is connected at its respective opposite ends to bases for the respective blades 51B and 51C and strap 20E similarly is connected adjacent its opposite ends to respective bases 51C and 51A. Straps 20C, 20D and 20E synchronize the movement of the blades in their movement from one position to the other of the operative positions.

From the foregoing described arrangement it will be realized the straps are flexible synchronizing links connecting the propeller blade bases so that the blades move in unison from one position to the other as they pivot about the axis of their respective mounting pivot pins. If for example a force is applied to blade 53A to pivot it from its operative position in FIG. 3 to the inoperative position shown in FIG. 4 strap 20E connected at one end thereof to base 51A and at the other end to base 51C will pull blade 53C to its inoperative positions and movement of blade 53C will cause strap 20D to move blade 53B to its inoperative position.

As the propeller shaft rotates centrifugal force causes the blades to pivot to their outward operative position. When the propeller shaft stops water striking the blades, by virtue of forward movement of the vessel, will force the blades to fold inward to their inoperative position. To avoid imbalance the blades must open and fold in sync. The straps attached to the partial double cones on each blade base ensure such synchronized movement. If one blade tends to open or close quicker than the others the strap will pull the adjacent blade which will in turn pull the next blade until all are fully opened or closed depending upon the direction of movement. The synchronizing links accordingly are subjected only to tension and their rolling contact with the rounded surfaces on the propeller blade bases results in little or no slack in such links.

The links may be a plastics material, or metal, or reinforced rubber or combinations or subcombinations thereof. The links are preferably a non-stretchable belting material able to withstand and operate without deterioration in a fresh water and/or salt water environment.

Figure 7:
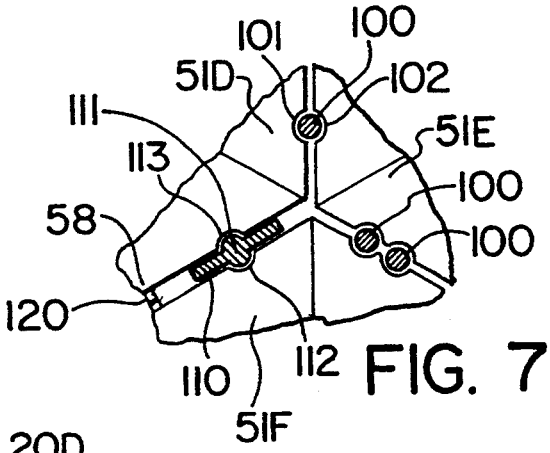
FIG. 7 is a partial view illustrating modifications to the blade synchronizing links.

While straps as the synchronising links are preferred flexible cables can also be used to replace the straps. FIG. 7 illustrates various modifications in a three bladed propeller, the portion shown in the Figure being adjacent the pivot axis of the propeller. FIG. 7 is a view similar to FIG. 3, but showing only a portion of propeller blade bases that are designated 51D, 51E and 51F and these are the equivalent of bases 51A, 51B and 51C of FIG. 3. As one modification the synchronising link between the bases 51D and 51E is a single flexible cable 100 suitably anchored at opposite ends thereof as is with the case with the straps in the previous embodiment. With reference to FIG. 3 cable 100 as a replacement of strap 20C would be anchored at opposite ends by means 81 and 82. The cable 100 fits partially into a groove 101 in base 51D and partially into a groove 102 in base 51E. The curved bases are closely adjacent one another dictating that the cable remain captive in the groove. The path of the grooves are such as to minimize forces on the cable dictating that the cable follow in the groove during pivotal movement of the blades from one to the other of their respective operative and inoperative positions. It is to be understood that three cables 100 would replace the three straps 20C, 20D and 20E of FIG. 3. Two cables 100 are illustrated held captive between bases 51E and 51F by grooves in the respective bases. Any number of cables may be used or a ribbon may be used in the form of a multiplicity of cables side by side. Only one pair of cables 100 is shown and it is to be understood three such pairs would replace the straps 20C, 20D and 20E of FIG. 3.

In FIG. 7 there is also illustrated as another alternative consisting of a flexible strap 110 which may be substituted for any of straps 20A, 20B, 20C, 20D or 20E. In this embodiment the strap has a central enlargement designated 111 which projects into grooves 112 and 113 in respective propeller blade bases 51F and 51D.

The grooves are intended to retain the strap in position during movement of the propeller blades from one position to the other. Without the enlargement 111 the strap may have a tendency to work radially outwardly from the axis of rotation of the propeller.

In place of the enlargement 111 running in grooves this shifting of the strap can be counteracted by a further alternative in FIG. 7 which consists of a flange 120 on each of the bases. These flanges extend from base in an arc edge 58 in radially outwardly from the base with reference to the axis of the pivot pin mounting bore 52 shown in FIG. 5.

Figure 6:
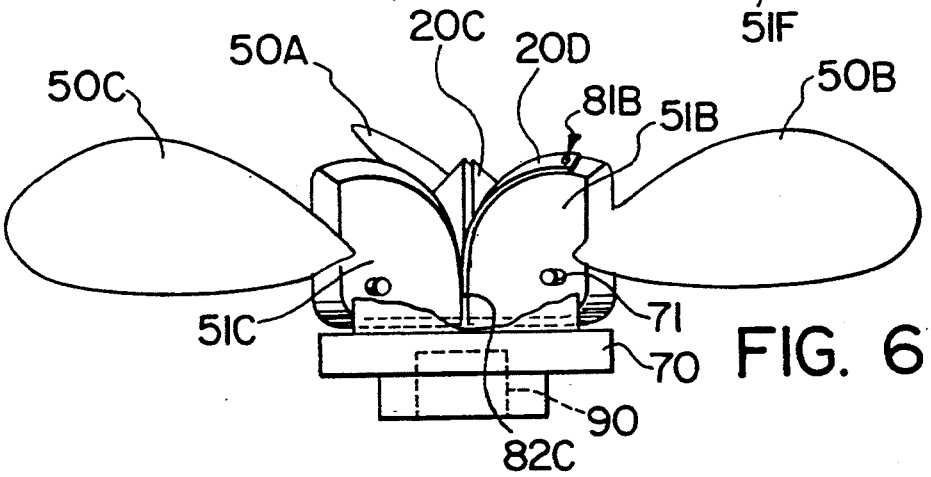
FIG. 6 is a side view taken essentially along line 6—6 of FIG. 3 but with the propeller bases being narrower in width.

FIG. 6 is a view essentially along line 6—6 of FIG. 3 and illustrates the mounting hub 70 with a recess 90 for mounting the propeller on a driven draft of a vessel. FIG. 6 is not of the same scale as FIG. 3 and the base of each propeller in FIG. 6 is narrower than in FIG. 3. The dimensioning is a matter of choice but what is important is the curved surfaces 55 and 56 on the base for rolling contact with the synchronizing flexible links. Preferably these surfaces are segmental back-to-back frusto-conical surfaces whose center of curvature coincides with the pivot axis of the propeller blade mounting pin.

I claim:

1. A boat motor propeller comprising:

a hub mountable on a driven shaft;

at least two propeller blades each having a base;

means attaching the respective blade bases to said hub for pivotal movement within a limited arc whereby the blades are pivotally movable from one to the other of an operative position and an inoperative position in which the blades are respectively substantially perpendicular and parallel to the axis of rotation of said driven shaft when the propeller is mounted thereon; and means interconnecting the bases of said propeller blades synchronizing their movement from said one to the other of said operative and inoperative positions, said means comprising link members each anchored at a first position to the base of one of said propeller blades and at a second position to the base of another blade, said link members being tension members in functional criss-cross relation, with said first and second positions being spaced apart from one another on each of the respective link members.

2. A propeller as defined in claim 1 wherein said link members are flexible link members and wherein there are as many as there are number of propeller blades.

3. A propeller as defined in claim 2 wherein said propeller bases each have a curved surface spaced from their pivot axis and wherein said flexible members are in rolling contact with said curved surfaces of the bases associated therewith.

4. A propeller as defined in claim 3 wherein each said flexible member is a strap, wherein said straps are disposed flatwise to the curved surface of the propeller base associated therewith and wherein said straps are disposed functionally in criss-cross relation relative to one another.

5. A propeller as defined in claim 2 wherein there are two propeller blades each pivotally attached to said hub and wherein said flexible link members comprise two straps.

6. A propeller as defined in claim 3 wherein there are two propeller blades and wherein each said curved surface is a segment of a cylinder.

7. A propeller as defined in claim 6 wherein the axis of the cylinder coincides with the pivot axis of the propeller blade associated therewith.

8. A propeller as defined in claim 2 wherein there are three propeller blades in which the pivot axes thereof are in a triangular array, wherein each base has a pair of back-to-back frusto-conical surface portions decreasing in diameter in a direction away from one another, said frusto-conical surface portions being disposed such that a frusto-conical surface portion on the base for one propeller blade is in face-to-face relation with another frusto-conical surface portion on an adjacently disposed base of another one of the propeller blades and wherein said link members comprise three flexible straps disposed functionally in a criss-cross relation with each connected at a first one end to the base for one propeller blade and at an opposite second end to the base of another propeller blade, said first one ends and second opposite ends for each of said respective flexible straps being spaced from one another and the pivot axis of the base associated therewith.

9. A propeller as defined in claim 2 wherein there are three propeller blades equally spaced in a triangular array on said hub, wherein the pivot axes of the blade bases are respective ones of the three sides of an isosceles triangle and lie in a plane disposed perpendicular to the axis of rotation of the propeller shaft, wherein there are three flexible links, said links being tension members functionally in criss-cross relation and each anchored at one end to the base of one propeller and at the opposite end to another base of different one of said propeller blades.

10. A propeller as defined in claim 3 wherein there are three propeller blades equally spaced from one another on said hub, wherein the pivot axes of the bases for said blades lie in a plane substantially transverse to the axis of rotation of said driven shaft and wherein there are three flexible links with a first one thereof anchored at a first position to the base of a first one of said blades and at a second position to the base of a second one of said blades, a second one of said flexible links being anchored at a first position to the base of said second one of said blades and at a second position to the base of the third one of said blades and the third one of said flexible links being anchored at a first position to the base of said third one of said blades and at a second position to the base of said first one of said blades, said first and second positions on the respective links being spaced apart from one another and spaced from the pivot axis of the base of the blade associated therewith, said first positions being similarly spaced from and more remote from said plane than said second positions, and wherein during movement of said blades from one to the other of their operative and inoperative positions said first and second positions move in directions generally toward and away from said plane.

11. A propeller as defined in claim 10 wherein each of said flexible links is a strap.

12. A propeller as defined in claim 11 wherein each of said straps has at least one enlargement providing oppositely directed ribs that extend longitudinally therealong and wherein there are grooves in the bases to receive respective ones of the ribs.

13. A propeller as defined in claim 10 wherein each of said flexible links comprises at least one flexible cable.

* * * * *